US005177906A

United States Patent [19]

Balding et al.

[11] Patent Number: 5,177,906

[45] Date of Patent: Jan. 12, 1993

[54] VIDEO GAME CONTACT CLEANING DEVICE

[76] Inventors: James G. Balding, 11925 Koenigstein, Santa Paula, Calif. 93060; Gary M. Todd, 16617 E. Jubilee Trail, Palmdale, Calif. 93550

[21] Appl. No.: 702,422

[22] Filed: May 20, 1991

[51] Int. Cl.[5] ..... B24D 3/00

[52] U.S. Cl. ..... 51/205 WG; 15/105; 15/118; 15/210.1; 51/392; 29/78

[58] Field of Search ..... 29/78, 79, 80; 15/104 S, 111, 236.08, 236.09, 105, 118, 209 D, 209 B, 210 R, 218.1, 245.1, 229.13, 229.11, 210.1; 51/392, 307, 205 WG, 295

[56] References Cited

U.S. PATENT DOCUMENTS

| | | | |
|---|---|---|---|
| 239,480 | 4/1876 | Thomas | 15/111 |
| 2,445,753 | 7/1948 | Anheuser | 29/78 |
| 2,816,351 | 12/1957 | Sauers | 29/78 |
| 3,050,827 | 8/1962 | Davies | 29/78 |
| 3,847,568 | 11/1974 | Cihon | 51/295 |
| 4,575,892 | 3/1986 | Ross | 15/160 |
| 4,584,745 | 4/1986 | Seiber | 29/78 |
| 4,625,725 | 12/1986 | Davison | 29/78 |
| 4,951,425 | 8/1990 | Naghi | 51/205 WG |
| 4,993,100 | 2/1991 | Halboth | 15/210 R |
| 5,025,526 | 6/1991 | Ichitsubo | 15/210 R |

FOREIGN PATENT DOCUMENTS

| | | | |
|---|---|---|---|
| 136629 | 12/1902 | Fed. Rep. of Germany | 29/79 |
| 426506 | 3/1926 | Fed. Rep. of Germany | 15/236.08 |
| 170529 | 3/1960 | Sweden | 15/104 S |

*Primary Examiner*—James E. Bryant, III
*Assistant Examiner*—Terrence R. Till
*Attorney, Agent, or Firm*—Robert M. Wallace

[57] ABSTRACT

An electrical edge connector cleaning device consisting of an essentially planar board having embossed areas at opposite ends that operate as an abrasive due to parallel striations used to create the embossed areas. The device is configured such that a first opposite end operates to clean male edge connectors by employing leverage means to assist in burnishing the connectors and a second opposite end operates to clean female edge connector sockets by embossing a top and a bottom surface of a lip that is then repeatedly inserted into and removed from a female edge connector socket to burnish the contacts.

15 Claims, 2 Drawing Sheets

VIDEO GAME CONTACT CLEANING DEVICE

BACKGROUND OF THE INVENTION

1. Field of the Invention

The present invention relates generally to the field of cleaning devices for circuit board connectors, and more specifically to abrasive devices used to clean edge connectors for circuit boards and circuit board sockets.

2. Description of the Prior Art

Many computers, and most personal computers, use circuit boards having input/output connectors that are typically referred to as edge connectors. Most home video games also use game cartridges having edge connectors to interface the game cartridge with the video game computer. Edge connectors, as with electrical connectors not manufactured using expensive gold alloys, chemically react with oxygen in the atmosphere to form a thin but non-conductive oxide layer which then acts as an insulator to inhibit the flow of current between the edge connector pad and the edge connector socket. In addition to chemical reactions related to oxidation, particulate contaminants such as dust, smoke and hydrocarbons in the environment operate to form insulating layers at the junction between edge connectors and edge connector sockets that prevent good electrical conduction.

Prior art methods for cleaning electrical contacts have employed such devices as Q-TIPs, cotton, cloth or felt layers adhered to planar boards or sticks, soaked with alcohol or mild soapy solutions to wipe the contact surfaces. These procedures while effective for male contact surfaces, such as the edge connectors, have been ineffective for female contact surfaces, such as the sockets used for edge connectors, due to the fact that the female contact surfaces are inherently recessed, making it difficult or impossible to reach the contact surface. Furthermore, these methods had little, if any, effect on chemically adhering oxide layers which inhibit electrical conduction. Additionally, these methods are undesirable due to the inconvenience of the liquid solvents involved.

More modern methods employ abrasive techniques to clean the insulating layers that form on contact surfaces. One such method is to employ a layer of burnishing material, such as commonly available aluminum oxide films, to a planar surface which can then be applied to the contact surfaces. While this has advantages over prior methods in cleaning female contact surfaces, the applied burnishing materials of prior teachings are actually applied to planar, surfaces rather than being part of the planar surface; thus, these films will themselves wear through the abrasive process and must be replaced. Furthermore, the application of burnishing materials contained in prior teachings has lacked insight for adapting even those techniques disclosed to a wide variety of uses.

Therefore, there is a long standing and continuing need within the teachings of the prior art for a convenient, inexpensive means to clean electrical contacts that is easily adaptable to a wide variety of uses.

SUMMARY OF THE INVENTION

The present invention provides an electrical contact cleaning device that is particularly suited to cleaning edge connector contacts and even more specifically to the cleaning of the connectors used in video games. Although the present invention is not limited to cleaning video games, as a further example of the present inventions usefulness computer card slots and the edge connectors typically used on computer circuit boards may also be burnished by the present invention.

Accordingly, the present invention provides a planar device having first and second opposite ends, upon which embossed areas formed from parallel striations composed of a percentage of crushed glass, operate as abrasives to burnish electrical contacts. The first end is formed specifically for the cleaning of male edge connectors and has cross members that provide leverage means whereby leverage can be applied through the handle that separates the first and second opposite ends. The second end is specifically formed for cleaning of female edge connector sockets and has the embossed area on both a top and a bottom surface of a lip. The lip is then inserted into the female socket and removed repeatedly to burnish the contacts. Guide rails assist the insertion of the lip.

The disclosure contained herein will make apparent the above described features as well as various modifications to those skilled in the art obvious when taken in conjunction with detailed description of the enclosed drawings.

DETAILED DESCRIPTION OF THE INVENTION

Figure 1:
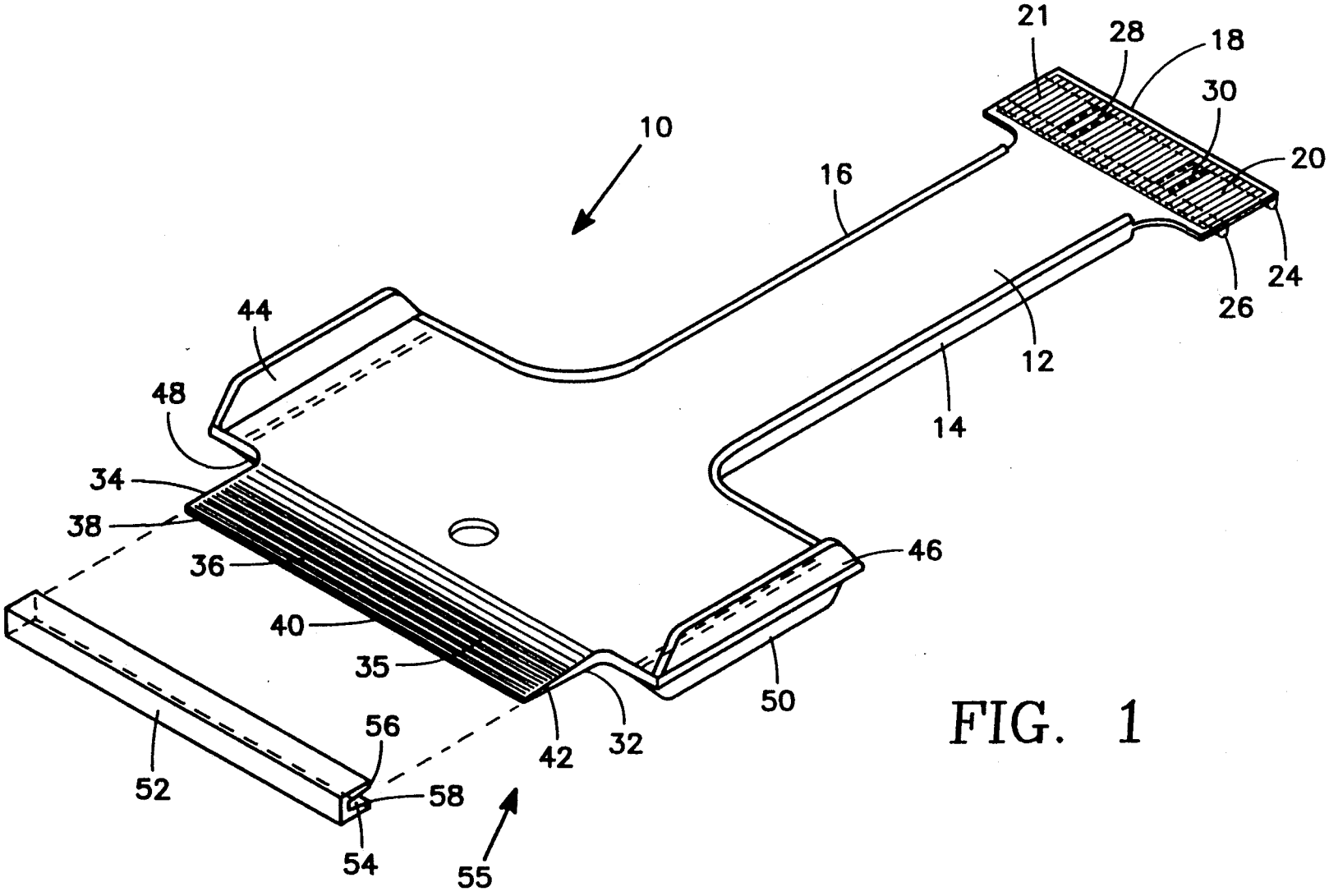
FIG. 1 is a perspective view of the invention being used to clean female electrical edge connectors.

Referring to FIG. 1, shown is a preferred embodiment of the invention, a tool 10 for cleaning electrical contacts is made of a plastic or a polymer material which is resilient, flexible and not easily broken. It is molded into basically a flat implement having a hand grip 12 strengthened by thickened ribbed support edges 14 and 16. The tool 10 has a first end 18 having an embossed area 20 formed in a rectangular shape by a plurality of parallel striations 21. The parallel striations 21 are an essential element of the invention and in the preferred embodiment of the invention consist of between 5–10% of crushed glass which gives the embossed area an abrasive effect on male edge connectors when the embossed area 20 of first end 18 is used with a scrubbing motion. A cross ribbed under-structure for the first end 18 is illustrated by dotted lines indicating parallel cross members 24, 26 and orthogonal cross members 28, 30. These cross members serve to provide support and rigidity. However, the cross members have a more specific function in the specific embodiment of the invention shown in FIG. 1 in which the invention as disclosed herein is used as an electrical contact cleaner for video games. Here, the first end 18 is used to clean the male electrical edge connector contacts on the game cartridge and cross members 24, 26, 28 and 30 operate to secure the embossed area 20 of the first end 18 against the inside of the game cartridge such that the embossed area 20 is pressed against the male edge connector contacts. The first end 18 is designed to have a width smaller than the width of the game cartridge to enable a lateral scrubbing movement in a direction perpendicular to the parallel striations 21, as shall be discussed further hereinbelow.

Still referring to FIG. 1, the second end 32 of the cleaning tool 10 is useful for cleaning the female edge connector contacts commonly used in video games. Here, the second end 32 has a lip 34 having an embossed area 35 consisting of parallel striations 36 again being composed of 5–10% crushed glass. The lip 34 is designed to be inserted into a video game in a manner similar to that used for inserting the video game cartridge. Thus, lip 34 tapers as it approaches edge 40 and edges 38,40 and 42 are beveled to ease insertion. The overall size and shape of lip 34 is compatible with the edge connector strip that is normally inserted into the video game. Beveled upper guide rails 44, 46 and beveled lower guide rails 48, 50 are designed to properly orient and position the second end 32 into the video game such that a repeated inserting and removing of lip 34 into the female edge connector strip inside the video game will remove undesired nonconductive layers that have formed on the female connectors through oxidation of the conductive material use to form the connectors or from particulate matter that exists in the ambient environment. Structural advantages are gained from employing rails 14, 16 on handle portion 12 by the addition of strength and rigidity. The second end 32 has lip 34 having embossed area 35 existing on both the top and bottom surfaces of lip 34 consisting of parallel striations 36. Here, the orientation of guide rails 46, 50 is seen as well as the distal relationship between first end 18, second end 32 and connecting handle portion 12.

FIG. 1 is a perspective view of the invention, as disclosed herein, and as such shows the present invention in its intended use as a tool 10 for cleaning electrical contact surfaces for female connector sockets 56, 58 that are compatible with male edge connectors. A typical female edge connector terminal 52 has a cavity 54 defined by female connector sockets 56,58 in which cavity 54 the lip 34 of the second end 32 of tool 10 is inserted. As a repeated insertion and removal motion is made as designated by arrow 55 parallel striations 36 contained on lip 34 remove insulating layers that may have formed on female connector sockets 56, 58. It needs to be understood that connector terminal 52 resides inside a computer or video game and that the computer or video game is not shown in FIG. 1 for the purposes of clarity. However, guide rails 44, 46, 48 and 50 are constructed to guide lip 34 into cavity 54 without error in the insertion process, due to the design of guide rails 44, 46, 48 and 50 being exactly matched for the computer or video game system in which they are to be used. Although the specific embodiment shown is for a video game in which connector terminal is recessed deep within the assembly of video game, the lip 34 containing parallel striations 36 can be used for other uses such as personal computer card slots in situations where the female edge connectors defining the card slot cavity are spaced the same as female edge connectors 56, 58 defining cavity 54 in the embodiment shown in FIG. 5.

Figure 2:
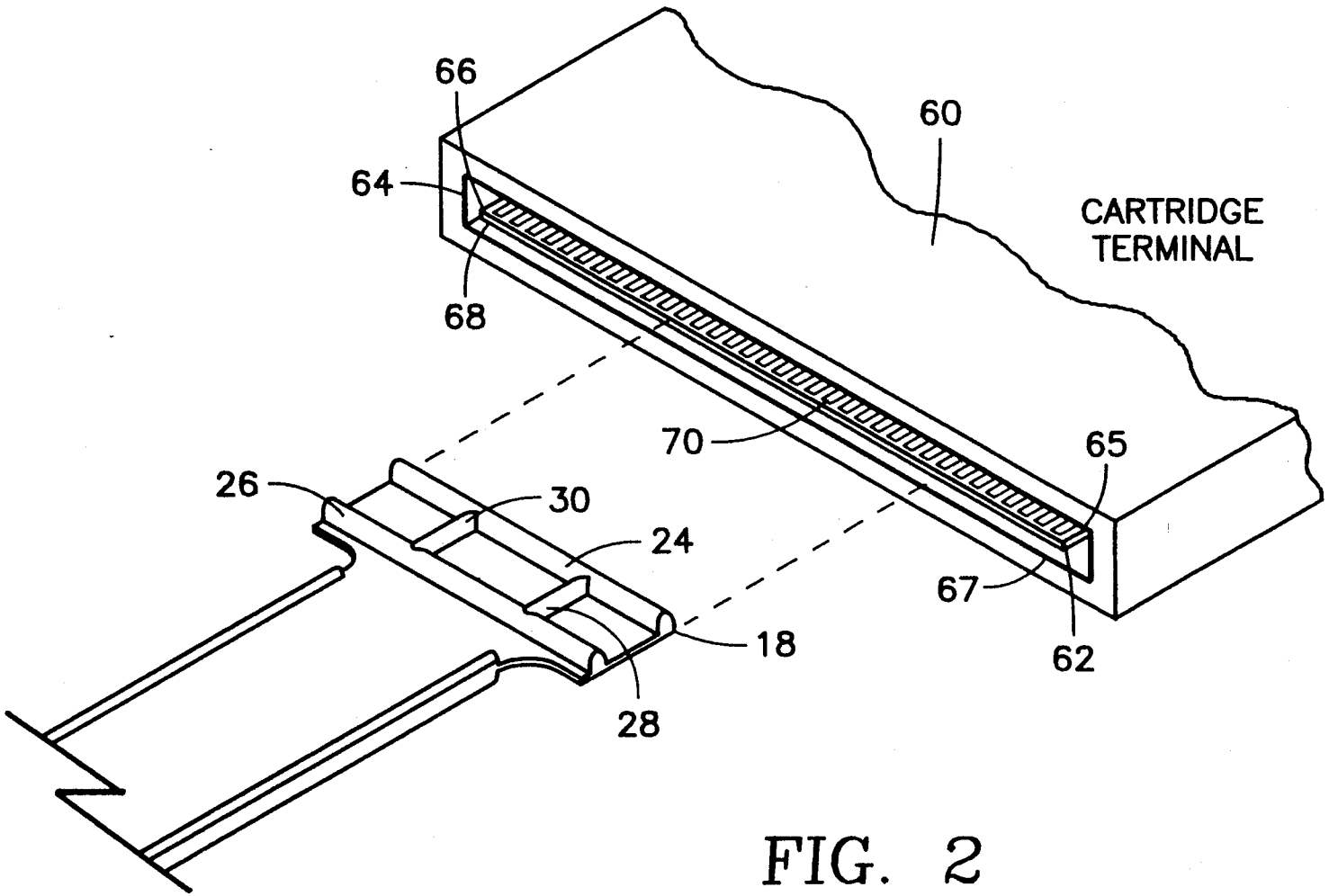
FIG. 2 is a perspective view of the invention being used to clean male edge connector strips.

Referring now to FIG. 2, the first end 18 of tool 10 is shown in a perspective view detailing the present invention's operation to clean male edge connectors 70. The male edge connectors 70 are contained on a shelf 62 within cartridge walls 64, all of which are contained as part of video game cartridge 60. The male edge connectors 70 exist on upper side 66 and lower side 68 of shelf 62. The embossed area 20 containing parallel striations 21 will be placed directly against male edge connectors 70 and cross members 24, 26, 28 and 30 will press against cartridge wall 64. Ridges 65, 67 are typically lip-type devices that exist in video game cartridges and the first end 18 of the tool 10 is constructed such that cross member 24 will rest against either ridge 65 or 67 depending on which strip of edge connectors are being burnished. Thus, an applied pressure is created and by moving tool 10 in direction of arrow 72 the male edge connectors will be burnished. Furthermore, increased pressure is easily achievable by using handle 12 as a lever resulting is even more significant burnishing of male edge connectors 70.

While the invention has been described in detail by specific reference to preferred embodiments thereof, it is understood that variations and modifications thereof may be made without departing from the true spirit and scope of the invention.

What is claimed is:

1. An apparatus having dual abrasive elements for cleaning electrical contacts comprising:

a planar board having a first end and a second end, said planar board being constructed from a resilient material of a class comprising plastic and polymer materials; and an embossed area contained on at least one of said ends near an edge of said planar board, said embossed area consisting of a plurality of parallel striations, said parallel striations comprising a first one of said dual abrasive elements, said striations being formed with an abrasive material in said resilient material, said abrasive material comprising a second one of said dual abrasive elements.

2. The apparatus of claim 1 wherein said abrasive material comprises a percentage of crushed glass particles in said resilient material of said planar board.

3. The apparatus of claim 2 wherein said striations are formed on a top surface and a bottom surface at said end.

4. The apparatus of claim 2 wherein said embossed area is formed at each said first end and said second end, said first embossed area formed at said first end for cleaning of a male edge connector, and said second embossed area formed at said second end for cleaning of a female socket compatible with said male edge connector.

5. The apparatus of claim 4 wherein said first embossed area is formed on a top surface of said first end with said parallel striations being perpendicular to the edge of said planar board on which said first embossed area is formed.

6. The apparatus of claim 5 wherein said female socket comprises a pair of parallel rows of generally planar conductors with an elongate female cavity therebetween, said striations of said second end being small relative to individual elements of said generally planar conductors, and wherein said second embossed area is formed on a top surface and a bottom surface at said second end such that said parallel striations are parallel to the edge of the board containing said second embossed area, said second end being of a thickness corresponding to a height of said elongate female cavity such that said second end is insertable into said female cavity of said female socket and is operative in burnishing said conductors of both rows of said female socket by insertion and removal into and out of said female cavity.

7. The apparatus of claim 6 wherein said second end has a pair of top guide rails on said top surface and a pair of bottom guide rails on said bottom surface, said guide rails being operative to assist in proper insertion and removal of said second end into female electrical contacts.

8. The apparatus of claim 7 wherein said male edge connector comprises a row of planar conductors and a rigid planar lip surface above said row of planar conductors, said striations of said first end being small relative to individual elements of said planar conductors, said apparatus further comprising:

a male guide member formed on a bottom surface of said first end, said male guide member contacting said rigid planar lip surface whenever said first embossed area contacts said row of planar conductors, whereby said male guide member is operative to hold said first embossed area against the planar conductors of said male edge connector with sufficient force such that rubbing said first end with said first embossed area against said row of planar conductors of said male edge connector burnishes said planar conductors.

9. The apparatus of claim 8 wherein:

said row of planar conductors of said male edge connector spans a first width, and said embossed area of said first end spans a fraction of said first width, whereby said row of planar conductors of said male edge connector are burnished upon movement of said first end in a direction parallel to said row of planar conductors across said first width, said straitions of said first end being perpendicular to said direction of said movement of said first end; and said elongate female cavity of said female socket spans a second width corresponding to said first width, and said embossed area of said second end spans said second width, whereby all of said generally planar conductors of said female socket are burnished upon said insertion and removal, said insertion and removal comprising a movement of said second end in a direction perpendicular to said pair of rows of generally planar conductors of said female socket, said striations of said second end being perpendicular to said direction of movement of said second end.

10. An apparatus having dual abrasive elements for cleaning edge connectors of planar circuit boards of the type used in computers and home video games, comprising:

an elongated planar board having first and second opposite ends, and a handle between said opposite ends, said planar board being constructed from a resilient material of a class comprising plastic and polymer materials; and a first embossed area contained on said first end and a second embossed area contained on said second end, said first and second embossed areas being formed near an edge of said planar board, each of said embossed areas consisting of a plurality of parallel striations, said parallel straitions comprising a first one of said dual abrasive elements, said straitions being formed of an abrasive material embedded in said resilient material, said abrasive material comprising a second one of said dual abrasive elements.

11. The apparatus of claim 10 wherein said abrasive material comprises a percentage of crushed glass particles in said resilient material of said planar board.

12. The apparatus of claim 11 wherein said second end is formed with said embossed area encompassing a top and a bottom surface of a lip such that said lip can be inserted into a female edge connector such as those used on a computer board slot or a video game terminal computer slot with said embossed area firmly rests against both rows of female edge connectors, whereby repeated insertion and removal of said lip burnishes the female connectors.

13. The apparatus of claim 12 wherein said second end has a plurality of rail guides to assist in proper insertion and removal of said lip.

14. The apparatus of claim 13 wherein said first end is adapted to burnishing male edge connectors used in video game cartridges by constructing said first end narrower than the strip of connectors to be burnished and further by providing leverage means, said leverage means consisting of a plurality of cross members on an opposite surface to that containing said first embossed area, such that said first embossed area can rest against the male edge connectors of the video cartridge with said cross members resting against the wall of the video cartridge and said handle means can apply force.

15. The apparatus of claim 6 wherein said second end tapers toward the edge of said planar board containing said second embossed area to a thickness corresponding to said height of said elongate cavity.

* * * * *